US009171488B2

(12) United States Patent
Beier et al.

(10) Patent No.: US 9,171,488 B2
(45) Date of Patent: Oct. 27, 2015

(54) OPTICAL DISPLAY ELEMENT AND DISPLAY DEVICE

(75) Inventors: Axel Beier, Schildow (DE); Martin Franke, Berlin (DE); Stefan Nerreter, Heidesee OT Blossin (DE); Volker Türck, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 221 days.

(21) Appl. No.: 13/636,746

(22) PCT Filed: Mar. 22, 2011

(86) PCT No.: PCT/EP2011/054293

§ 371 (c)(1),
(2), (4) Date: Oct. 10, 2012

(87) PCT Pub. No.: WO2011/117217

PCT Pub. Date: Sep. 29, 2011

(65) Prior Publication Data

US 2013/0063951 A1 Mar. 14, 2013

(30) Foreign Application Priority Data

Mar. 24, 2010 (DE) ..... 10 2010 012 971

(51) Int. Cl.
*F21S 8/00* (2006.01)
*G09F 9/33* (2006.01)
(Continued)

(52) U.S. Cl.
CPC . *G09F 9/33* (2013.01); *F21V 5/008* (2013.01); *G09F 2013/0472* (2013.01)

(58) Field of Classification Search
CPC . G09F 2013/0472; G09F 9/33; F21V 21/045; F21V 21/047; F21V 5/007; F21V 5/008; F21S 8/03; G02B 3/0062; G02B 27/4277; G02B 27/4272; G02B 3/0068
USPC ..... 362/268, 433, 331, 812, 332, 326, 225, 362/217.02
See application file for complete search history.

(56) References Cited

U.S. PATENT DOCUMENTS 6,249,375 B1 6/2001 Silhengst et al.
6,290,378 B1 * 9/2001 Buchalla et al. ..... 362/494
(Continued)

FOREIGN PATENT DOCUMENTS

CA 2 434 724 A1 9/2002
DE 20 2004 009 121 U1 9/2004
(Continued)

OTHER PUBLICATIONS

Wanninger, LED display device, Aug. 30, 2006, English translation.*
(Continued)

*Primary Examiner* — Mary McManmon
*Assistant Examiner* — James Endo
(74) *Attorney, Agent, or Firm* — Laurence A. Greenberg; Werner H. Stemer; Ralph E. Locher

(57) ABSTRACT

A display element and a display device in which the display element is mounted. The display may be a variable message sign. The sign includes a tube-like housing in which lenses and apertures can be disposed. The light exiting a light source is emitted via an emitting surface, by way of which an illuminated traffic sign results from interacting with further display elements. The light source and the optical elements are disposed at different heights in the horizontally oriented housing. The optical axes can thereby extend horizontally, or the optical elements can lie on a main axis which is tilted downward in an radiation direction. In both cases, sunlight impinging from above at an angle advantageously falls on the LED to a slight degree, by way of which the phantom light phenomenon is minimized.

12 Claims, 2 Drawing Sheets

(51) Int. Cl.
*F21V 5/00* (2015.01)
*G09F 13/04* (2006.01)

(56) References Cited

U.S. PATENT DOCUMENTS

| | | | | |
|---|---|---|---|---|
| 6,357,893 | B1 * | 3/2002 | Belliveau | 362/285 |
| 7,083,299 | B2 * | 8/2006 | Chapman | 362/188 |
| 7,584,564 | B2 | 9/2009 | Matsuda et al. | |
| 8,622,581 | B2 * | 1/2014 | Tsao | 362/268 |
| 2001/0015893 | A1 * | 8/2001 | Campman | 362/184 |
| 2004/0201980 | A1 * | 10/2004 | Fischer et al. | 362/84 |
| 2006/0077661 | A1 | 4/2006 | Eschbach | |
| 2007/0217198 | A1 * | 9/2007 | Alessio | 362/268 |
| 2008/0101067 | A1 * | 5/2008 | Cariboni | 362/245 |
| 2009/0303445 | A1 * | 12/2009 | Drazic et al. | 353/34 |
| 2010/0259151 | A1 * | 10/2010 | Chen et al. | 313/110 |
| 2011/0051427 | A1 * | 3/2011 | Zhang | 362/311.08 |
| 2011/0058358 | A1 * | 3/2011 | Soo et al. | 362/147 |
| 2011/0075428 | A1 * | 3/2011 | Chen et al. | 362/311.02 |

FOREIGN PATENT DOCUMENTS

| | | | |
|---|---|---|---|
| EP | 0 930 600 | A1 | 7/1999 |
| EP | 1 643 473 | A1 | 4/2006 |
| EP | 1 696 171 | A1 | 8/2006 |
| EP | 1 593 109 | B1 | 4/2009 |
| FR | 2863686 | A1 | 6/2005 |
| RU | 2319220 | C2 | 3/2008 |
| WO | 02/17628 | A2 | 2/2002 |
| WO | 2004/068447 | A1 | 8/2004 |

OTHER PUBLICATIONS

LM Electronic e. K., "Flexible-LED-Streifen" Datenblatt-Power3 DE, Version 10.01.

* cited by examiner

OPTICAL DISPLAY ELEMENT AND DISPLAY DEVICE

BACKGROUND OF THE INVENTION

Field of the Invention

The invention relates to an optical display element, which is suitable in particular for luminous variable message signs or display boards. Said optical display element has a substantially tubular housing, whose profile, in the installed position, is aligned at least substantially horizontally. The profile of the housing is understood to mean the direction predetermined by the longitudinal extent of the tubular housing. At an input-side end, the housing is provided with a receptacle for a light source, into which in particular one LED can be installed. At the output-side end, there is an exit region for the light emitted by the light source. The exit region therefore enables the light emitted by the light source to be capable of leaving the housing. This can be ensured, for example, by a housing opening, which is preferably formed by a transparent wall part of the housing. This wall part, which can also be formed by a lens, needs to be transparent for the light emitted by the light source insofar as this is the useful light which is intended to cause the optical display element to illuminate. In addition, at least one optical element is arranged in the beam path between the receptacle region and the exit region. In the broadest sense, all elements which influence the optical response of the display element are referred to as optical elements. In particular, this can take place by means of lenses or apertures, with the apertures preferably having a hole in order to allow the beams of light to pass through.

An optical display element of the type mentioned at the outset is known, for example, from EP 1 593 109 B1 and from EP 930 600 A1. These optical display elements which can be installed in a display device such as a variable message sign comprise a tubular housing, into which an LED as light source can be clipped. First, a converging lens which focuses the light emitted by the LED is located in the beam path of the LED, with an aperture being located at the focal point, said aperture being in the form of an integral part of the housing. At the output-side end of the housing, there is a beam-shaping lens. This is understood to mean, for example, a converging lens with which the emission characteristics of the light emitted by the LED are determined, i.e. which so to speak shapes the beams emerging from the display element. In this case, it is necessary to take into consideration the relevant specifications for variable message signs, such as are prescribed, for example, in accordance with the standard DIN EN 12966-1 in respect of light color, luminance, luminescence ratio, emission width and uniformity.

The tubular housings are water-tight and are installed in the display device in an arrangement which is required for representing the message signs. Said display device comprises, for example, a plate which has receiving openings suitable for the display elements. The display elements are inserted and fixed in said receiving openings in a suitable manner.

LEDs are generally known as light source. In particular, there are also LEDs in the form of SMDs which can be fitted on flexible circuit carriers, for example. Such LEDs which have already been prefitted on a strip of a flexible circuit carrier are marketed by the company LM-Electronic e. K., for example, as can be gleaned, for example, from the "Power3" product data sheet, version 10.01.

These requirements need to be met in order for it to be possible for the variable message sign to be read reliably. There is additionally a phenomenon which is referred to as phantom light. Phantom light arises when, in particular when the sun is low, the sunlight falls into the interior of the display element through the emitting optical system of the display element and, by means of reflection preferably at the light source, is emitted again in a sufficient proportion through the beam-shaping lens of the display element, with the result that the viewer is given the incorrect impression that the display element in question is illuminated at that time. This can result in the variable message sign being interpreted incorrectly or no longer being readable, and this therefore needs to be avoided. Therefore, the formation of the phenomenon of phantom light needs to be suppressed or at least care needs to be taken to ensure that the phantom light does not occur above an intensity which results in misinterpretation by the viewer of the variable message sign.

Measures which reduce or suppress the formation of phantom light are, for example, an external shield above the light-emitting optical system, an aperture in the interior of the housing of the display element and a light-absorbing coating on the housing interior.

BRIEF SUMMARY OF THE INVENTION

The object of the invention consists in specifying an optical display element or a display device for fitting this display element which can be produced inexpensively and can be used to suppress, comparatively effectively, the phenomenon of phantom light.

This object is achieved with the display element mentioned at the outset in accordance with the invention by virtue of the fact that the receptacle provided for the light source and the optical element or the optical elements (if more than one is provided) are arranged with respect to one another in such a way that a height offset results between each of said optical elements and receptacle. The height offset is determinable on the basis of the horizontal alignment of the housing. For example it is possible to imagine, for example, a housing mid-axis, with the height offset h being determinable perpendicular to this horizontal axis by virtue of in each case one central point of the optical element, for example the center of gravity, being determined in each case and the position of this in relation to the imaginary housing axis being determined. In the case of central-symmetrical optical elements, this center of gravity lies on the optical axis of the optical element.

In accordance with an advantageous configuration of the invention, the optical axes of the light source to be installed in the receptacle and of the at least one optical element run horizontally with respect to one another. The height offset therefore results from the distance between the respective optical axes. In this case, a stepped arrangement of the light source to be installed in the receptacle and of the at least one optical element, preferably the plurality of optical elements, is advantageous. The optical axis of the light source to be installed in the receptacle is the highest, with the optical axis of the optical element following in the beam path of the emitted light being slightly lower and the optical axis of the next optical element being slightly lower again until the light leaves the housing. In this case, however, individual optical elements can also be arranged independently of this for example with their optical axes precisely in the mid-axis of the housing. The arrangement of the light source to be installed is determined by the configuration of the receptacle provided for this. Suitable receptacles which enable reliable fixing in the desired installation position can also be provided for the other optical elements. In particular, apertures can also be formed by integral component parts of the housing, with the result that it is not necessary for an additional optical element for the aperture to be installed.

It is advantageous if the respective height offset h between adjacent optical elements and/or the light source to be installed in the receptacle (in this case the light source and the optical element adjacent to the light source is intended, is from 0.5 to 2% of the length of the housing. The length of the housing is in this case understood to mean the length which is to be measured between the light source installed in the receptacle and the last optical system located in the beam path of the light source. This length will substantially correspond to the housing length itself to be measured on the outside in the case of conventional designs of the housing. If the housing length and the height offset are given the specified relationship with respect to one another, this has the advantage that the offset is firstly still so little that an undisrupted beam path can be produced from the light source to the last optical element located in the beam path. Secondly, the offset means that the light source is elevated sufficiently in relation to the optical axis of the housing in order that sunlight incident at an angle from above, which could produce phantom light, cannot impinge on the LED or light source, or can only do so to a lesser extent. Therefore, reflections are also avoided, which could result in the optical impression of the LEDs being illuminated.

Alternatively, the elevated position of the light source can also be achieved by virtue of the fact that the optical axes of the light source to be installed into the receptacle and of the at least one optical element run downwards with an inclination, when viewed towards the output-side end of the housing. In this case, a height offset can additionally be provided, as has already been described. Particularly preferably, the optical axes of the light source to be installed in the receptacle and of the at least one optical element (preferably a plurality of optical elements) lie on a common main axis. It is thus advantageously possible, even without a height offset between the individual optical elements and the light source, for the light source to be arranged higher in the housing (i.e. with a height offset). The beam path of the emitted light is then disrupted to a lesser extent than when the optical axes of the optical elements are spaced apart from one another. As a result, losses during the passage of the light through the housing can advantageously be minimized. In addition, the inclination of the optical axes counteract the circumstance that the light emitted by the display elements should be directed slightly downwards in the case of variable message signs in order that vehicles which travel beneath the fitted variable message sign can still identify the variable message sign until just before they pass through. An inclination of the optical axes with respect to the horizontal of between 2 and 5°, preferably 3.5° is particularly advantageous for finding a compromise between suppressing, or at least making markedly more difficult, the formation of phantom light, on the one hand, and the capacity to read the variable message sign at a sufficient distance and still sufficiently close, on the other hand.

Advantageously, at least one converging lens is used in the emission region of the receptacle, i.e. in the region where a light source fitted in the receptacle would illuminate the converging lens, and an aperture are used as optical elements. The aperture is provided at the focal point of the converging lens, which focal point is turned away from the receptacle, i.e. opposite the fitted light source. As a result of the fact that the aperture is at the focal point of the converging lens, the opening can be comparatively small, with the light emitted by the light source, insofar as this light is focused by the converging lens, being capable of passing the aperture completely. However, light entering from outside, in particular the sunlight when the sun is low, can pass through the aperture only in the region of the aperture opening and therefore only a small proportion of this light can advance up to the light source. The formation of phantom light is thus advantageously minimized.

It is furthermore advantageous if a beam-shaping lens is arranged in the exit region. Said beam-shaping lens can likewise have a height offset with respect to the mid-axis of the housing or be tilted. However, it is also possible for the beam-shaping lens to be provided centered in the housing and for its optical axis to be aligned precisely horizontally. As a result, advantageously a reliable termination of the housing in the exit region can be produced by the beam-shaping lens. The required emission characteristic can be influenced by the design of the beam-shaping lens. In particular, it is advantageous for the beam-shaping lens to have an astigmatic configuration, with the result that said beam-shaping lens does not have a rotationally symmetrical design. As a result, for example, various opening angles can be produced in the horizontal and vertical direction. The light signal to be emitted can thus be matched to the requirements for the variable message sign.

A particular embodiment of the invention is achieved when a fastening apparatus is provided on the housing and enables installation in only one angular position, measured in a plane to which the housing runs perpendicular. A rotationally-secure and position-secure fitting of the display element, for example in the variable message sign is thus advantageously possible, so to speak. This is necessary since the effect produced by the height offset or the inclined optical axis only comes into effect when the housing is in the correct installed position. For this purpose, for example, a suitable receptacle needs to be provided in the display board which is intended to form the variable message sign, with it being possible for the display element with the fastening device to be inserted into said receptacle in a defined position. A rotationally-secure fitting is advantageous also for an astigmatic lens in order that said lens ensures the desired emission characteristic. A fastening device for fastening in a defined angular position can also be provided for the fitting of the astigmatic lens.

It is further advantageous if the LED which forms the light source is in the form of an SMD and is fitted for contact-making on a flexible printed circuit board. In this way, a large number of LEDs can also be fitted easily since said LEDs are already fitted on the flexible printed circuit board and can be inserted into the individual receptacles in the housings by possible deformation of the printed circuit board with little fitting complexity. In particular, the flexible printed circuit board is in the form of a narrow strip, on which the LEDs are arranged next to one another in a row.

The object specified at the outset is also achieved by a display device, such as a luminous variable message sign or a display board, for example, in which a plurality of display elements are fitted in rotationally-secure fashion, as has been described in more detail above. In this way, the display elements according to the invention can advantageously be assembled to form the display device, with it being possible for the requirements placed on the variable message sign to be displayed, for example, to be taken into consideration.

Further details relating to the invention are described below with reference to the drawing. Identical or corresponding elements of the drawing are each provided with the same reference symbols and will only be explained more than once insofar as there are differences between the individual figures. In the figures:

DESCRIPTION OF THE INVENTION

Figure 2:
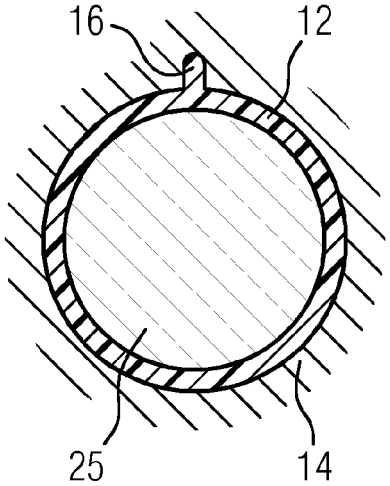
FIG. 2 shows the section II-II shown in FIG. 1, showing a device for fitting the display element in the correct position.

A display element 11 has a housing 12, which is substantially cylindrical. The housing 12 is inserted with an output-side end 13 into a display device 14 in the form of a display board. For this purpose, the display device 14 has a suitable opening. The housing 12 is provided with a flange 15, which ensures a defined position of the housing 12 in the axial direction. In addition, a rib 16 is provided on the outside of the housing and corresponds to a corresponding groove (not illustrated in any more detail) in the opening in the display device. As a result, the angular position of the housing 12 in the display device 14 is also defined precisely, as can be seen from FIG. 2.

Figure 3:
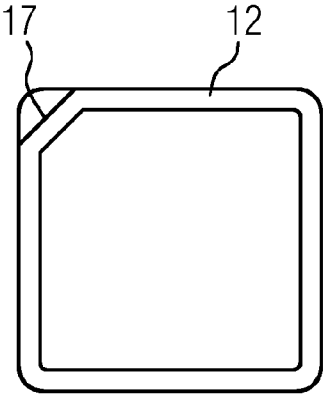
FIGS. 3 and 4 show alternative elements which ensure fitting in the correct position, in a plan view.
Figure 4:
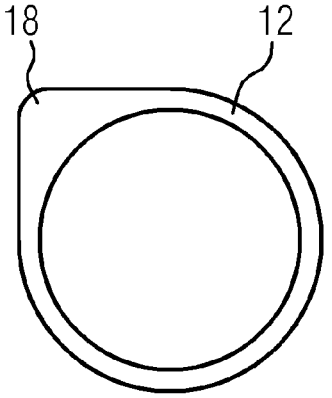

Alternative configurations for elements which ensure a defined angular position of the housing 12 in the display device 14 are illustrated in FIGS. 3 and 4. In FIG. 3, the housing has a square cross section, for example, with this cross section being beveled at least at the output-side end in one corner. A corresponding opening for installation purposes is provided in the display device 14, with the result that only one installed position of the housing 12 is possible. As can be seen from FIG. 4, instead of a flat portion 17 of the housing shown in FIG. 3 or a rib 16 shown in FIG. 2, a thicker wall portion 18 can also be used, which results in a droplet-shaped outer contour of the housing 12 at least in the region of the output-side end. This also ensures an installed position of the housing with a defined angle.

Figure 1:
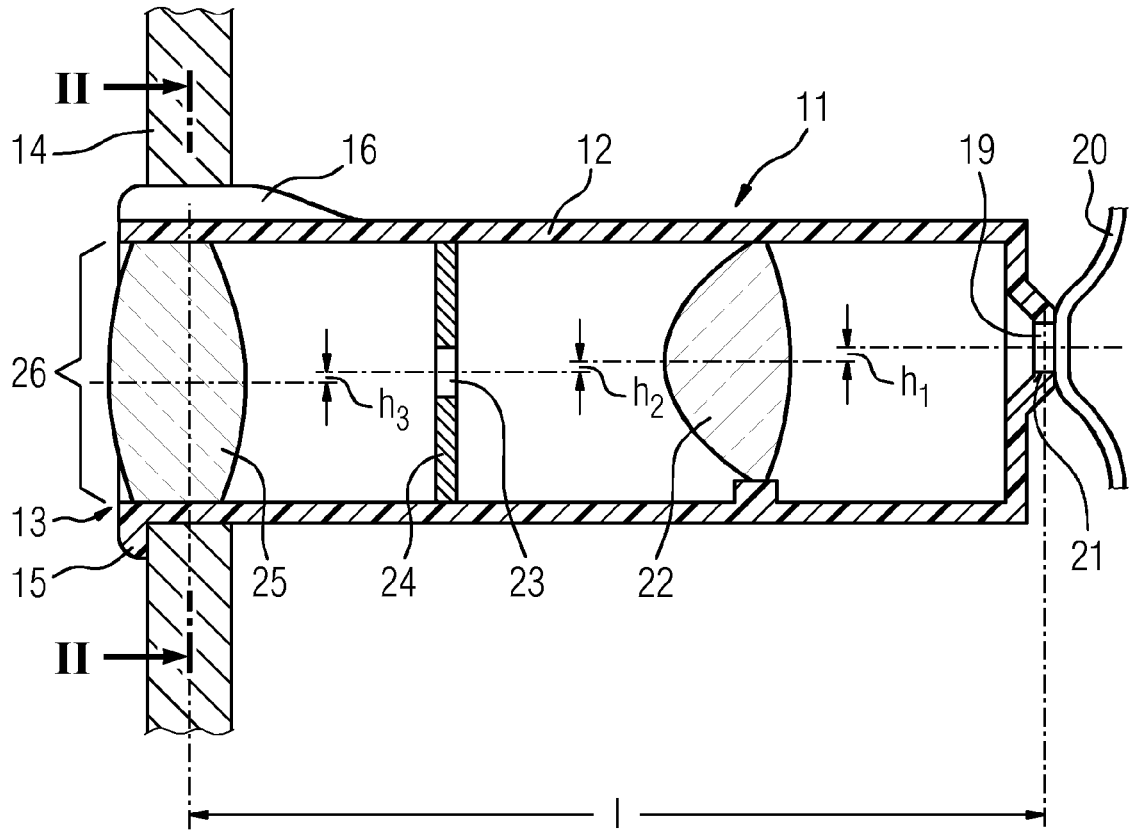
FIG. 1 shows an exemplary embodiment of the display element according to the invention with a stepped optical axis, installed in an exemplary embodiment of a display device according to the invention, in a schematic section.

FIG. 1 also shows that an LED 19 in the form of an SMD is used as light source. The LED is fitted on a flexible circuit carrier 20 in the form of a long strip. Further LEDs are not illustrated, but these LEDs are provided and are connected to further housings (likewise not illustrated). A receptacle 21 is provided in the housing 12 for the LED 19. A beam path (not illustrated in any further detail) of the light emitted by the LED 19 passes through a converging lens 22, which focuses this light. The opening 23 in an aperture 24 through which the light passes is located at the focal point of the converging lens 22, which focal point is turned away from the LED 19, and the light is emitted in a suitable angular range by a beam-shaping lens 25, which forms the exit region 26 for the light.

It can furthermore be seen from FIG. 1 that the optical axes of the LED 19, the converging lens 22, the aperture 24 and the beam-shaping lens 25 each run horizontally. However, in each case one stepwise height offset h is provided between these axes, with the LED 19 being located at the highest point and the beam-shaping lens being located at the lowest point. The height offset $h_1$ between the LED 19 and the converging lens 22 is 0.23 mm, the height offset $h_2$ between the converging lens 22 and the aperture 23 is 0.4 mm, and the height offset $h_3$ between the aperture 24 and the beam-shaping lens 25 is 0.56 mm. The housing length which is measured starting in each case from the central points of the beam-shaping lens 25 and the LED 19, is 40 mm. In this arrangement, the respective height offset h between the individual optical elements have the effect that the beam path through the optical elements is inclined slightly downwards. This corresponds to the desired emission characteristic in the exit region 26 of the housing.

Figure 5:
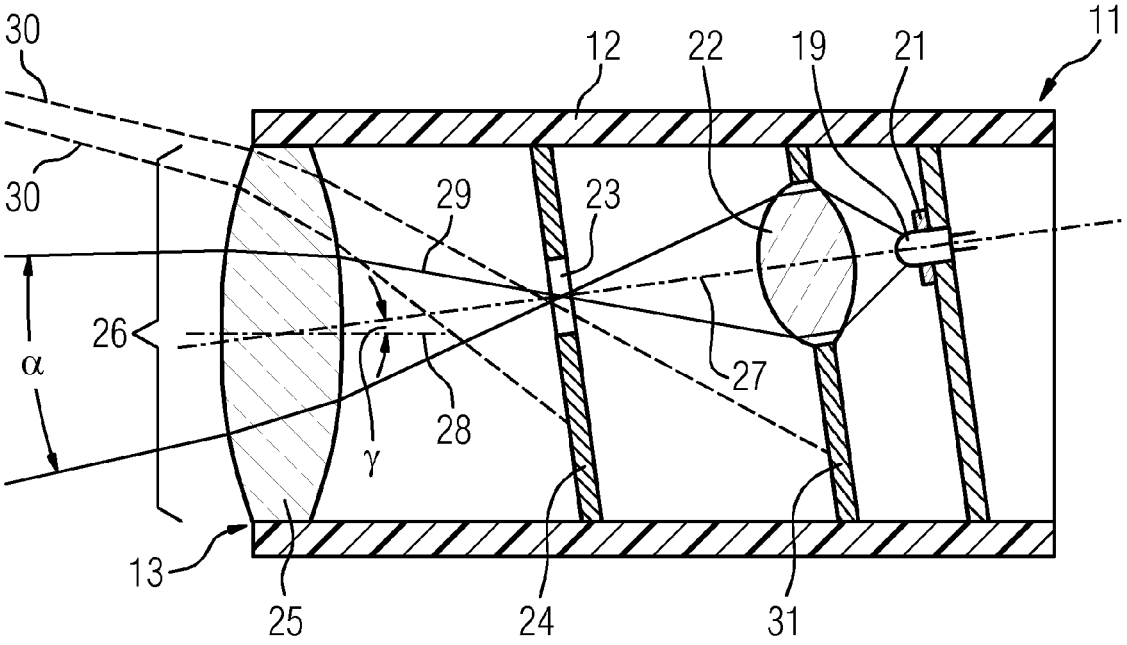
FIGS. 5 and 6 show exemplary embodiments of the display element according to the invention with a titled optical axis, in schematic section.

FIG. 5 illustrates another configuration of the display element. In this figure, the LED 19, the converging lens 22 and the aperture 24 are located with their optical axes on a common main axis 27, which is inclined through an angle $\gamma$ with respect to the horizontally aligned mid-axis 28 of the housing 11. As can be seen from an indicated beam path 29, said beam path is likewise inclined downwards through said angle $\gamma$.

The beam-shaping lens 25, in contrast to the other optical elements, is aligned at the mid-axis 28 of the housing such that its optical axis is identical to the mid-axis 28. The beam-shaping lens has the effect that the light emitted by the LED 19 with a downwards inclination at the angle $\gamma$ is emitted at an angle $\alpha>0°$, where the angle $\alpha$ is critical in respect of the distance range in front of the display element in which the light emitted by the LED 19 can be perceived, for example from a vehicle traveling beneath the display element.

Furthermore, two sun rays 30 are indicated by way of example by dashed lines in FIG. 5. As can be seen, these sun rays are either projected onto the aperture 24 outside the opening 23 or, when a sun ray passes through the opening 23, are captured by a retaining plate 31 for the converging lens 22. An absorption layer (not illustrated in any further detail) can be fitted both on the aperture 24, on the retaining plate 31 and on the inner wall of the housing 12 in the housing interior (of the housings 11 shown in FIGS. 1, 5 and 6), as a result of which the sun rays are absorbed. It is thus more difficult for incident sun rays to reach the LED 19.

Figure 6:
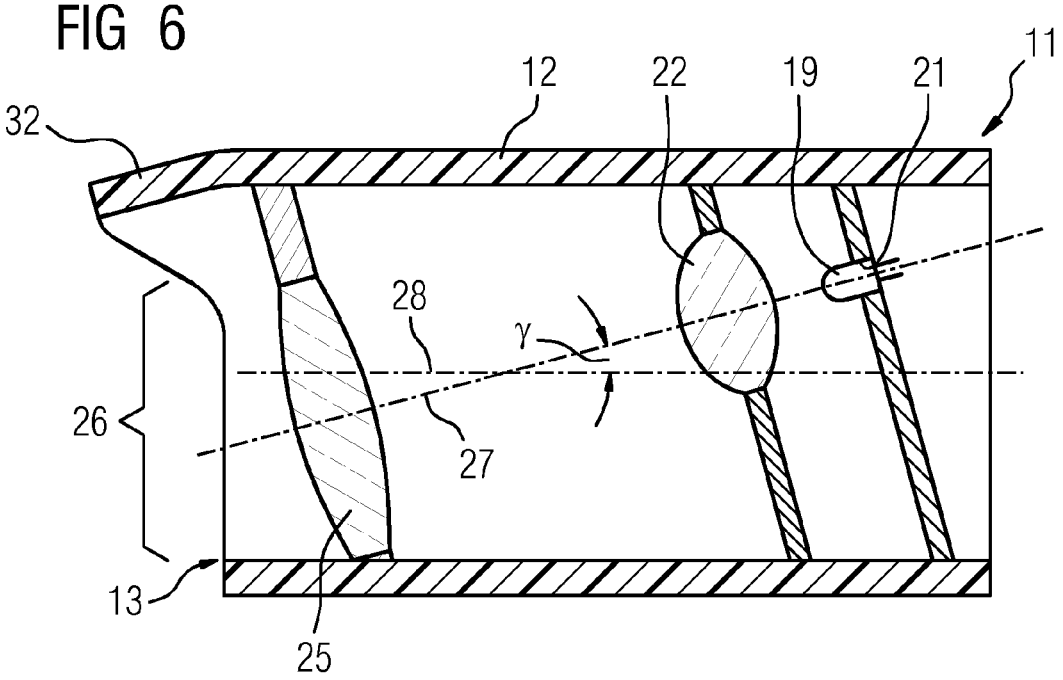

The display element shown in FIG. 6 differs from that shown in FIG. 5 in that the beam-shaping lens 25 is also arranged on the main axis 27. As a result of the tipping through the angle $\gamma$, the beam-shaping lens migrates slightly into the housing 12, for which reason protection against incident sunlight can also be provided by means of a shield 32, which is fitted to the upper part of the output-side end 13 of the housing 12. For this reason, there is also no need for an aperture in the display element shown in FIG. 6.

The invention claimed is:

1. An optical display element for luminous variable message signs or display boards, comprising:

a substantially tubular housing disposed in an at least substantially horizontal orientation and having an input-side end, an output-side end, and a housing mid-axis extending in the substantially horizontal direction;

a receptacle for a light source disposed at said input-side end, said receptacle having an optical axis;

an exit region at said output-side end for light emitted by the light source; and a plurality of optical elements each having an optical axis extending substantially horizontally, said optical elements including a lens or a cover and being disposed in a beam path of the light source between said receptacle and said exit region;

said receptacle and said optical elements being arranged relative to one another to define, from said receptacle to said exit region, a stepped height offset with respect to said housing mid-axis between said optical axes of each said optical elements and said optical axis of said receptacle, with each of said optical axes of said optical elements being offset in a given vertical direction from the optical axis of a respectively preceding optical element in the beam path.

2. The display element according to claim 1, wherein said optical elements are selected from the group consisting of a lens, a cover, and an aperture.

3. The display element according to claim 1, wherein said light source is an LED.

4. The display element according to claim 1, wherein said light source to be installed in said receptacle and said optical elements have optical axes running horizontally and said optical axes are disposed non-coaxially.

5. The display element according to claim 4, wherein a respective said height offset between adjacent optical elements and/or the light source to be installed in said receptacle is from 0.5 to 2% of a length of said tubular housing.

6. The display element according to claim 1, wherein said optical elements comprise a converging lens disposed in an emission region of said receptacle; and an aperture lying at a focal point of said converging lens distally from said receptacle.

7. The display element according to claim 1, which comprises a beam-shaping lens disposed in said exit region.

8. The display element according to claim 7, wherein said beam-shaping lens has an astigmatic configuration.

9. The display element according to claim 1, which comprises a fastening apparatus mounted to said housing, said fastening apparatus being configured to enable an installation in only one angular position, measured in a plane to which said housing runs perpendicular.

10. The display element according to claim 1, wherein said light source is an LED in the form of an SMD and fitted for contact-making purposes on a flexible circuit carrier.

11. A display device, comprising a plurality of display elements according to claim 1 mounted in rotationally secure fashion.

12. The display device according to claim 11, configured as a luminous variable message sign or a display board.

* * * * *